United States Patent [19]

Plaskett

[11] Patent Number: 4,656,810

[45] Date of Patent: Apr. 14, 1987

[54] APPARATUS FOR AUTOMATICALLY LOCKING L-SLIDE LOCK CARTONS

[75] Inventor: John Plaskett, Dallas, Tex.

[73] Assignee: Frito-Lay, Inc., Dallas, Tex.

[21] Appl. No.: 880,687

[22] Filed: Jul. 1, 1986

[51] Int. Cl.[4] ..... B65B 7/24

[52] U.S. Cl. ..... 53/374; 493/136; 493/453

[58] Field of Search ..... 53/374, 376, 377, 564, 53/484; 493/137, 139, 136, 183, 453

[56] References Cited

U.S. PATENT DOCUMENTS

| | | | |
|---|---|---|---|
| 2,277,289 | 3/1942 | Bergstein et al. | 493/135 |
| 2,660,012 | 11/1953 | Boyce et al. | 53/376 |
| 3,002,432 | 10/1961 | Wendshuh | 493/263 |
| 3,960,313 | 6/1976 | Sax et al. | 206/167 X |
| 4,441,303 | 4/1984 | Langen | 53/374 |
| 4,584,818 | 4/1986 | Plaskett | 53/374 |

*Primary Examiner*—James F. Coan

*Attorney, Agent, or Firm*—Bernard, Rothwell & Brown

[57] ABSTRACT

Apparatus for locking a top of a case having an unlocked closing flap and L-slide lock slots for receiving opposite free end corners of the closing flap includes a closing flap securing device which provides a source of suction for detachably securing a top surface of a generally horizontal unlocked closing flap of a stationary case. Movement of the securing device from a generally horizontal position to a generally inclined position while secured to the closing flap first forms a longitudinal fold in the closing flap and positions the opposite free end corners of the closing flap adjacent respective L-slide lock slots. Subsequent movement of the securing device from the generally inclined position to the generally horizontal position then flattens the longitudinal fold and tucks the opposite free end corners of the closing flap into the respective L-slide lock slots to thereby lock the case. Suction from the closing flap securing device is then terminated to detach the securing device from the top surface of the closing flap of the case.

18 Claims, 19 Drawing Figures

APPARATUS FOR AUTOMATICALLY LOCKING L-SLIDE LOCK CARTONS

BACKGROUND OF THE INVENTION

1. Field of the Invention

This invention relates to an apparatus for automatically locking a top closing flap on an L-slide lock case.

2. Description of Background Art

There is much prior art on apparatus for setting up as well as closing cartons and the like utilizing various members to contact carton flaps and tuck or insert them for closing purposes. U.S. Pat. Nos. 2,660,012 and 3,002,432 are exemplary of such prior art.

Cartons having L-slide locks are commercially available in various sizes from Stone Container Corp. Such cartons or cases are used by Frito-Lay, Inc. to package bags of snack foods such as potato chips, corn chips, and the like, for shipment. The L-slide locks on the cartons make them easy to close by just inserting the opposite ends of an upstanding flap into the lock slots. L-slide lock cases are used for shipment of snack bags because they are re-usable and can be closed without the use of glue, staples, tape, or other destructive closure means. When the cases are emptied, they are collapsible as set forth in U.S. Pat. Nos. 3,960,313 and 4,007,869, for ease in shipment back to the factory to be refilled. L-slide lock cases have heretofore been manually closed after the bags of product were packed into the case. The obvious drawbacks to manual closing are that it is labor-intensive, time-consuming and hence extremely expensive. However, there have been several obstacles to a commercially practical L-slide lock closing apparatus. Examples of these obstacles include the varying sizes of the L-slide lock cases corresponding to different size bags of snack foods, and the different directional orientations that the cases are packed.

There is need in the art for a relatively simple and efficient, automatic case closing apparatus for L-slide lock cartons which is easily adjustable for different size cases and different packing orientations.

SUMMARY OF THE INVENTION

In accordance with the present invention, an apparatus for locking a top of a case having an unlocked closing flap and L-slide lock slots for receiving opposite free end corners of the closing flap, includes a closing flap securing member for detachably securing a top surface of a generally horizontal unlocked closing flap of a stationary case. The case has a generally horizontally oriented top portion which includes the closing flap, the closing flap being connected to a top end of a side of the case. The closing flap has a free longitudinal edge and opposite free end corners, the free longitudinal edge being at about a level of a top end of the side of the case. The top portion of the case further includes L-slide lock slots for receiving respective free end corners of the closing flap. Means are provided for moving the closing flap securing member between a generally horizontal position and a generally inclined position relative to the top portion of the stationary case while the securing member is secured to the closing flap and while the free longitudinal edge of the closing flap remains at about the level of the top end of the side of the case. Movement of the securing member from the generally horizontal position to the generally inclined position first forms a longitudinal fold in the closing flap and positions the opposite free end corners of the closing flap adjacent respective L-slide lock slots. Subsequent movement of the securing member from the generally inclined position to the generally horizontal position flattens the longitudinal fold and tucks the opposite free end corners of the closing flap into the respective L-slide lock slots to thereby lock the case.

DETAILED DESCRIPTION OF THE PREFERRED EMBODIMENTS

Figure 1A:
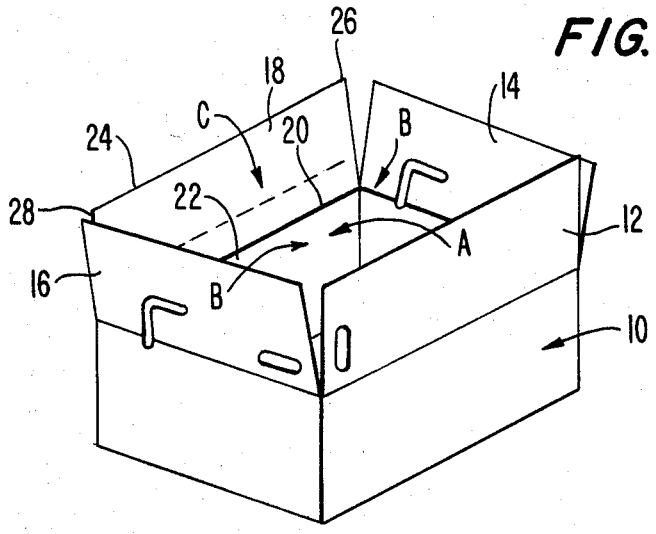
FIGS. 1A–1D are perspective views of an L-slide lock case showing the flap closing and locking sequence.

Referring to FIG. 1A, a case 10 of the L-slide lock type commercially available from Stone Container Corp. stands ready for packing and closing. After packing and before the case is locked, open flaps 12, 14 16, and 18 are sequentially closed by any suitable means known in the art. During the closing sequence, flap 12 is closed first, followed by flaps 14 and 16. Thereafter, flap 18 is closed to bring all of the flaps into the position shown in FIG. 1B. With the top flaps in the position shown in FIG. 1B, the case is ready for locking using the apparatus of this invention.

Figure 1B:
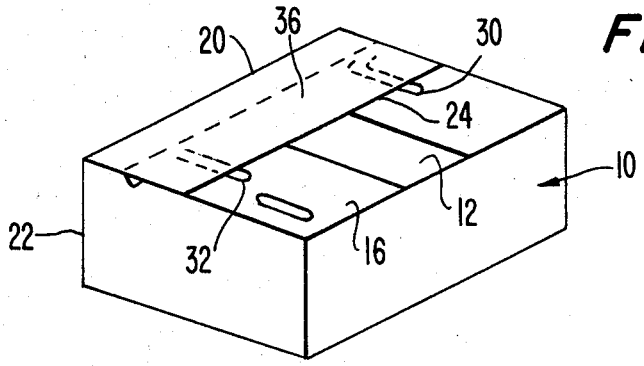

A closed but unlocked case as in FIG. 1B has a generally horizontally oriented top portion comprised of flaps 12, 14, 16 and closing flap 18, the closing flap being connected to a top end 20 of a rear side 22 of the case. The closing flap 18 has a free longitudinal edge 24 and opposite free end corners 26 and 28. The top portion further includes L-slide lock slots 30 and 32 in flaps 14 and 16, respectively, for receiving respective free end corners 26 and 28 of closing flap 18.

Figure 2A:
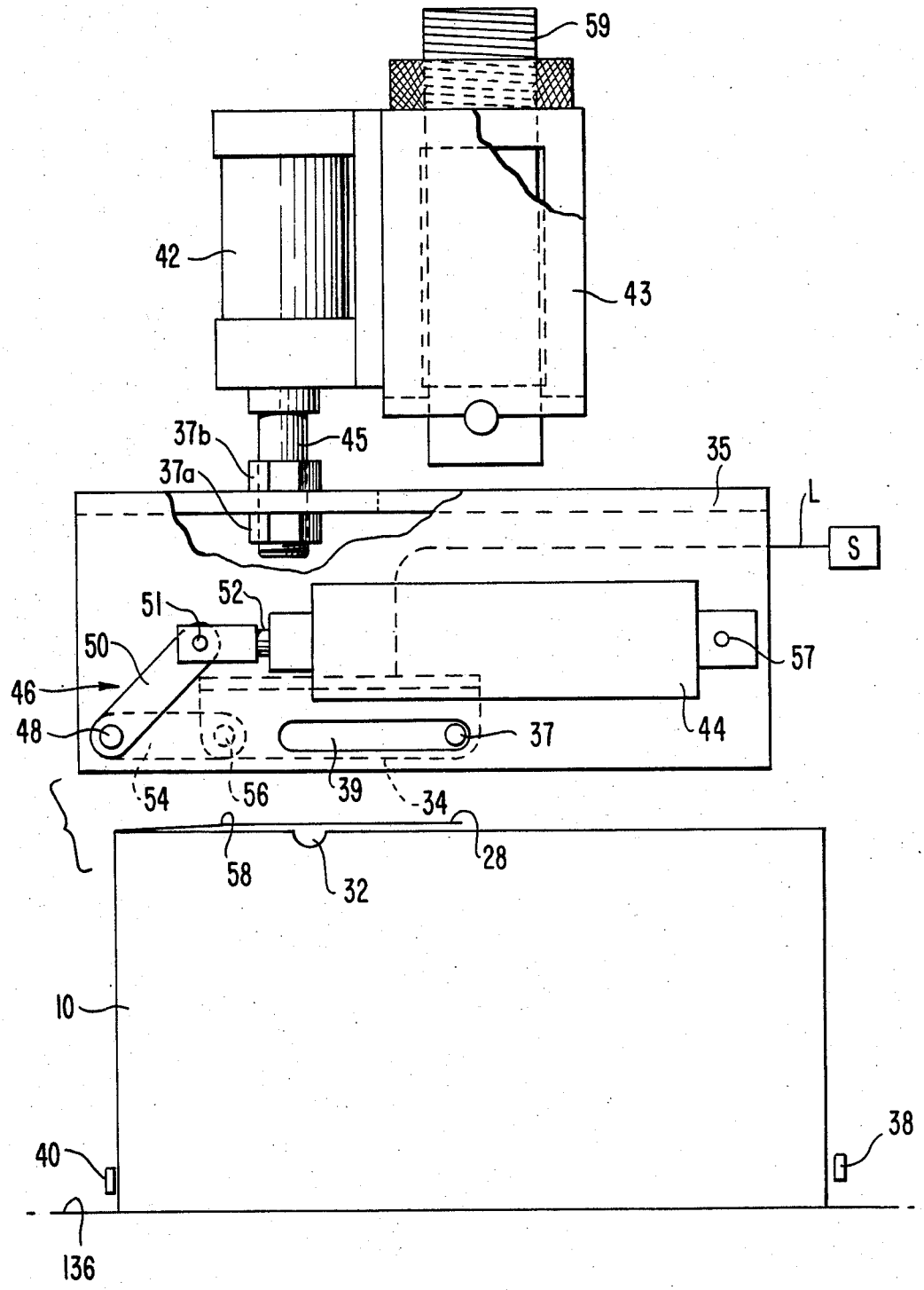
FIGS. 2A–2E are side elevation views, partly schematic, of a closing flap securing member according to the invention showing a sequence of positions of the closing flap securing member during the flap locking sequence shown in FIGS. 1B–1D.

An apparatus according to this invention includes a closing flap securing member 34 for detachably securing a top surface 36 of a generally horizontal unlocked closing flap 18. See FIGS. 1B, 2A and 2B. Securing member 34 is supported by slotted housing box 35, the securing member including a pair of pins 37 (one of which is shown in FIG. 2A). Pins 37 are slidable within complementary support and guide slots 39 (one shown in FIG. 2A) in housing box 35.

According to the embodiment shown in FIGS. 2A–2E, the closing flap securing member 34 applies suction to the top surface 36 of closing flap 18 to detachably secure the closing flap.

A closed but unlocked case as shown in FIGS. 1B and 2A is positioned beneath the closing flap securing member 34 by any suitable means, such as conveyor 136 shown schematically in FIG. 2A. When the case 10 has been properly positioned beneath the securing member 34, the case is securely held at the predetermined stationary position beneath closing flap securing member 34 by any suitable means, such as case bottom holding members 38 and 40, shown schematically in FIG. 2A.

Housing box 35 holding the closing flap securing member 34 then is lowered to the top portion of the case by a first cylinder 42. See FIG. 2B. Cylinder rod 45 of cylinder 42 reciprocates vertically and is connected to housing box 35 by attachments 37*a* and 37*b*, cylinder 42 being supported by cylinder support 43.

Suction is applied by the closing flap securing member 34 from line L and suction source S to the top surface 36 of closing flap 18 to secure the closing flap to the securing member 34.

Figure 2B:
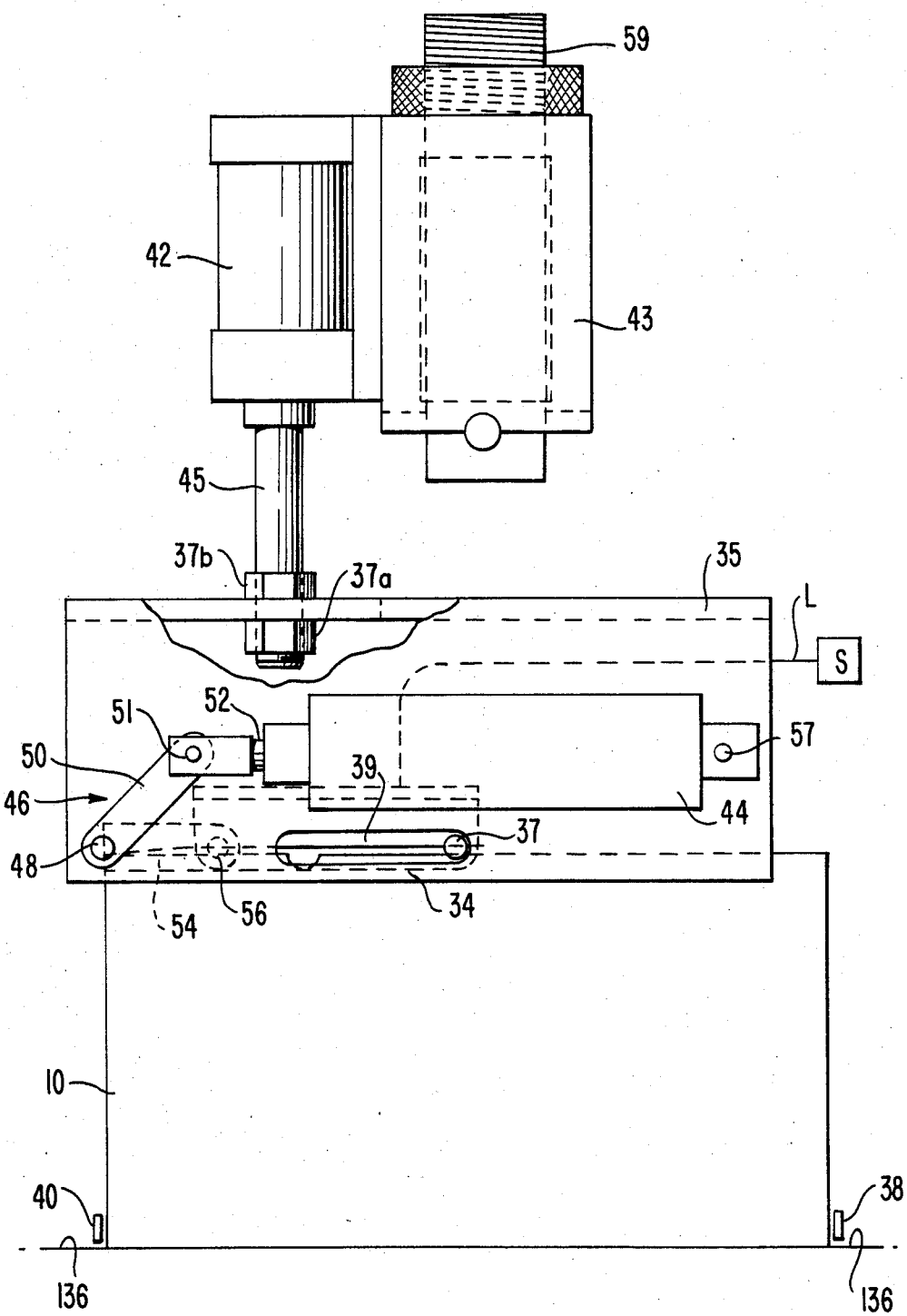
Figure 2C:
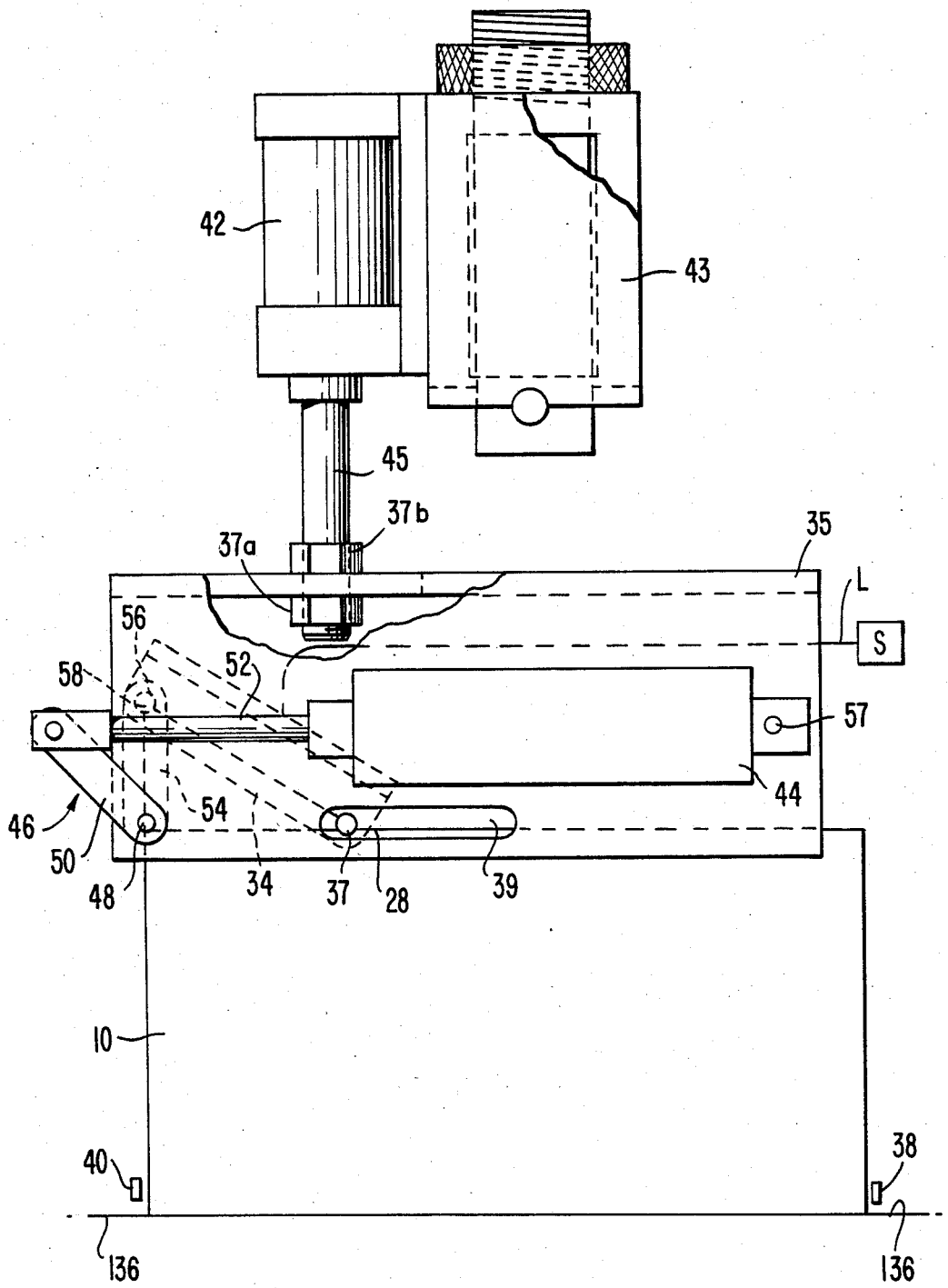
Figure 2D:
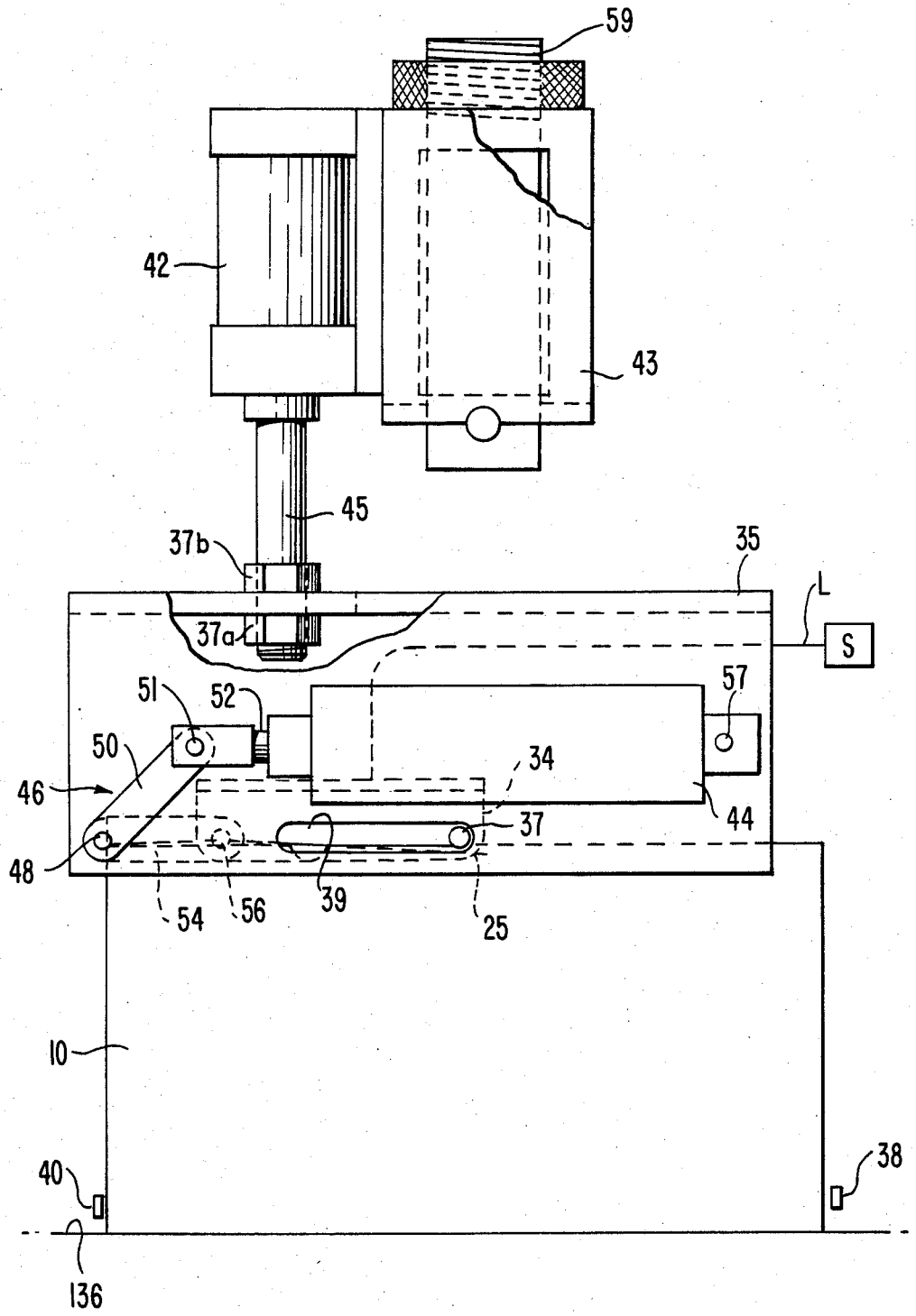
Figure 2E:
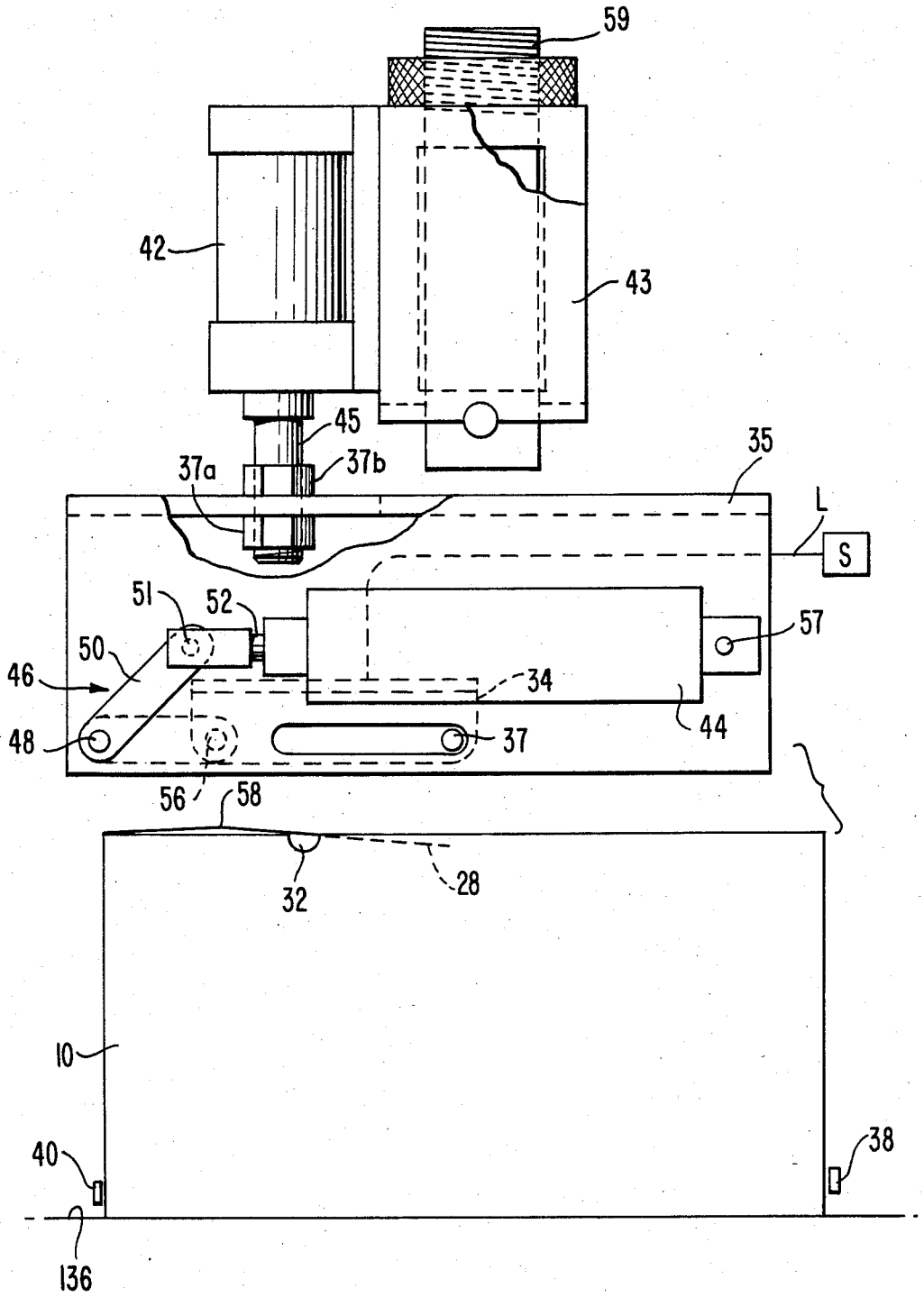
Figure 3:
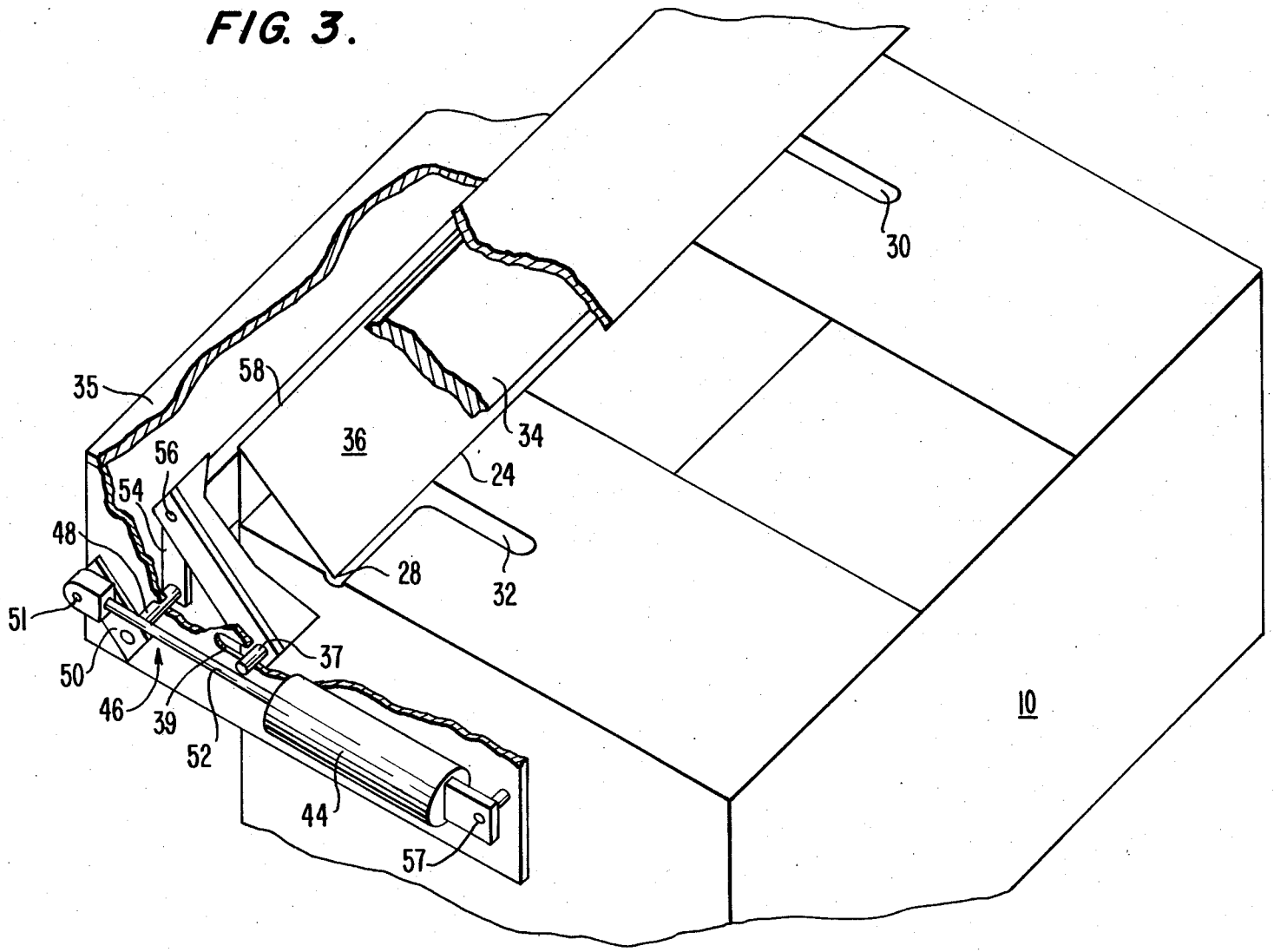
FIG. 3 is a perspective view, partly schematic, of the closing flap securing member in the position shown in FIG. 2C.

Means are provided for moving the closing flap securing member between the generally horizontal position shown in FIG. 2B and a generally inclined position shown in FIG. 2C and FIG. 3. In the embodiment shown, this movement is effected by operation of a second cylinder 44 connected to closing flap securing member 34 by means including an angled linkage 46 which is rotatable about an axis at pin 48 connecting the linkage 46 to housing box 35. Linkage 46 includes a first linkage member 50 pivotably connected to a horizontally reciprocating cylinder rod 52 of cylinder 44 at connection 51. Member 50 is fixedly connected with respect to a second linkage member 54 by pin 48. The second linkage member 54 is also connected to the closing flap securing member 34 at a pivotable connection 56. Cylinder 44 is supported by housing box 35 at connection 57.

Extension of cylinder 44 rotates linkage 46 at pin 48 and moves the securing member 34 to the position shown in FIGS. 2C and 3 with pins 37 sliding in complementary slots 39 of housing box 35. With the securing member 34 secured to flap 18, a longitudinal fold 58 is formed in closing flap 18 while the free longitudinal edge 24 of the closing flap remains at about a level with the top of the case. See FIG. 2C with reference to FIG. 1C and FIG. 3. Preferably, flap 18 has been previously scored by the manufacturer along the line at the position where fold 58 is formed.

Figure 1C:
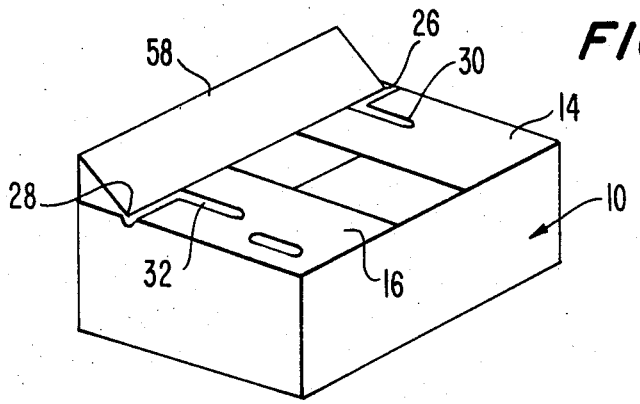
Figure 1D:
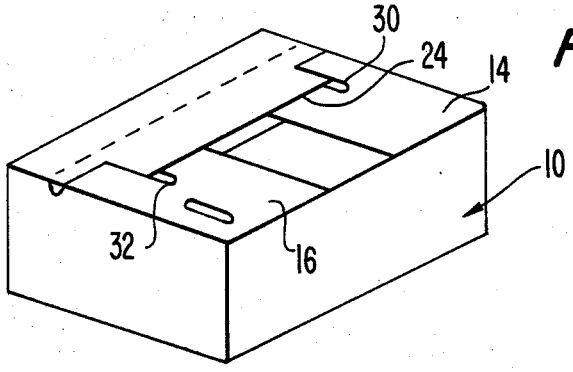

With the case configured as shown in FIGS. 1C, 2C and 3, the free end corners 26 and 28 of closing flap 18 are adjacent respective L-slide lock slots 30 and 32. Subsequent retraction of cylinder 44 moves the securing member 34 from the generally inclined position shown in FIGS. 2C and 3 to the generally horizontal position shown in FIG. 2D with the closing flap securing member 34 secured to the closing flap 18. Fold 58 in closing flap 18 is flattened and the opposite free end corners 26 and 28 are tucked into the respective L-slide lock slots 30 and 32 to lock the case. See FIG. 2D with reference to FIG. 1D. Advantageously, slight downward pressure supplied by cylinder 42 is exerted on the top of the case through securing member 34. Free end corners 26 and 28 easily pass under the L-slide lock tabs and into slots 30 and 32 with downward pressure exerted on the free longitudinal edge 24. The suction of securing member 34 then is released to detach the securing member from closing flap 18, and cylinder 42 is retracted to the position shown in FIG. 2E. Case holding members 38 and 40 are disengaged from the case, and the closed and locked case is free to be conveyed elsewhere by any suitable means such as conveyor 136 to make room for an unlocked case beneath support box 35.

Figure 5A:
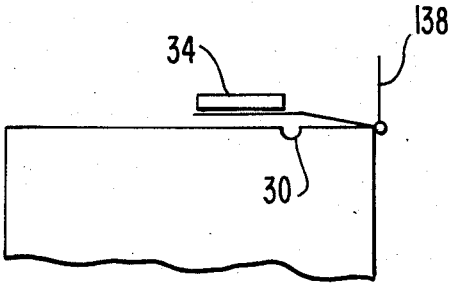
FIGS. 5A–5C are side elevational views, partly schematic, of a third embodiment of closing flap securing and lock means showing a sequence of positions during flap locking.
Figure 5B:
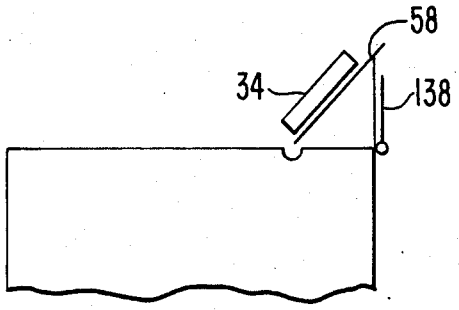
Figure 5C:
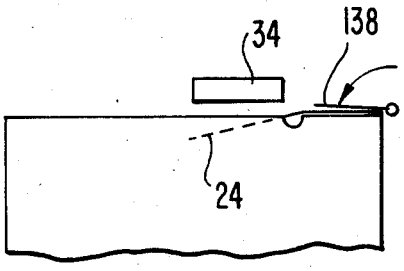

According to another embodiment, suction member 34 is releasably secured to closing flap 18 during folding thereof, with flattening of the closing flap being effected by an auxiliary flap pusher 138 to lock the flap. See FIGS. 5A, 5B and 5C.

Figure 4A:
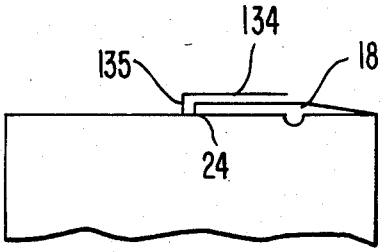
FIGS. 4A–4C are side elevational views, partly schematic, of a second embodiment of a closing flap securing member showing a sequence of positions during flap locking.
Figure 4B:
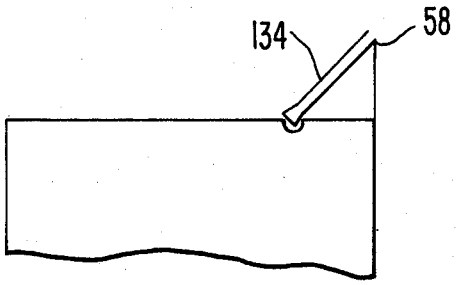
Figure 4C:
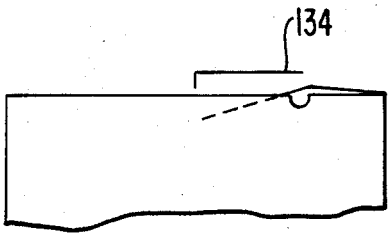

Means other than suction securing member 34 can be utilized to detachably secure closing flap 18 and lock the closing flap. See FIGS. 4A, 4B and 4C. For example, suction securing member 34 can be replaced by a hooked closing member 134 which secures the closing flap 18 with hook 135, but otherwise manipulates closing flap 18 in generally the same manner as described above with reference to the suction securing member 34.

Figure 6:
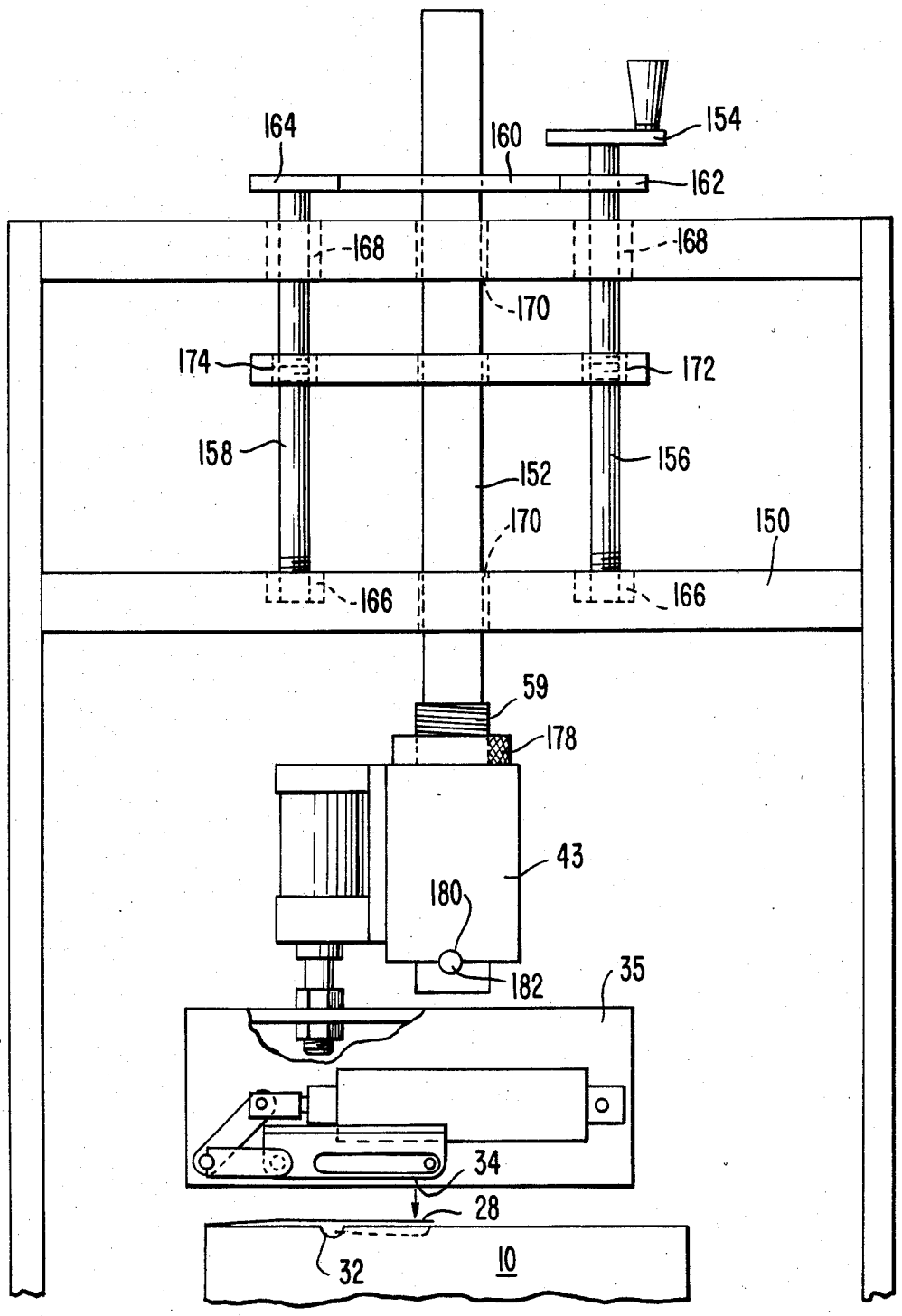
FIG. 6 is a side elevational view, partly schematic, of means for vertically adjusting a closing flap securing member according to the invention.

An apparatus according to the present invention is sufficiently compact and uncomplicated that it can easily be vertically adjusted. This solves a previous problem in the art by being able to lock cases of different heights. Suitable means for vertically adjusting the vertical height of an apparatus according to the invention is shown in FIG. 6. According to this embodiment, support box 35 is supported on a framework 150 by connection with main shaft 152. Rotation of hand wheel 154 rotates lead screw 156 connected thereto, as well as screw 158 operably connected to lead screw 156 by chain 160 and sprockets 162 and 164. Screws 156 and 158 are supported by framework 150 with bearing 166 and 168. Main shaft 152 is free to slide vertically within bushings 170 of framework 150, and is vertically displaceable during rotation of screws 156 and 158 within nuts 172 and 174 fixedly connected to main shaft 152.

Figure 7A:
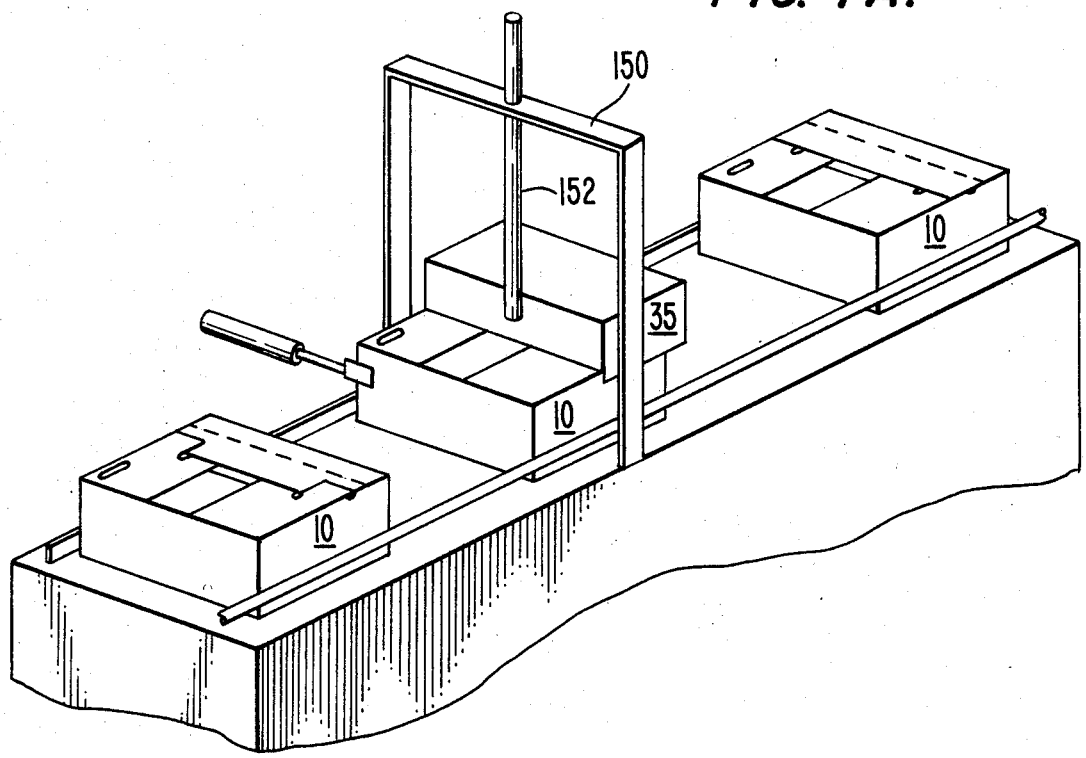
FIG. 7A is a perspective view, partly schematic, showing a case locking line for locking laterally oriented cases.
Figure 7B:
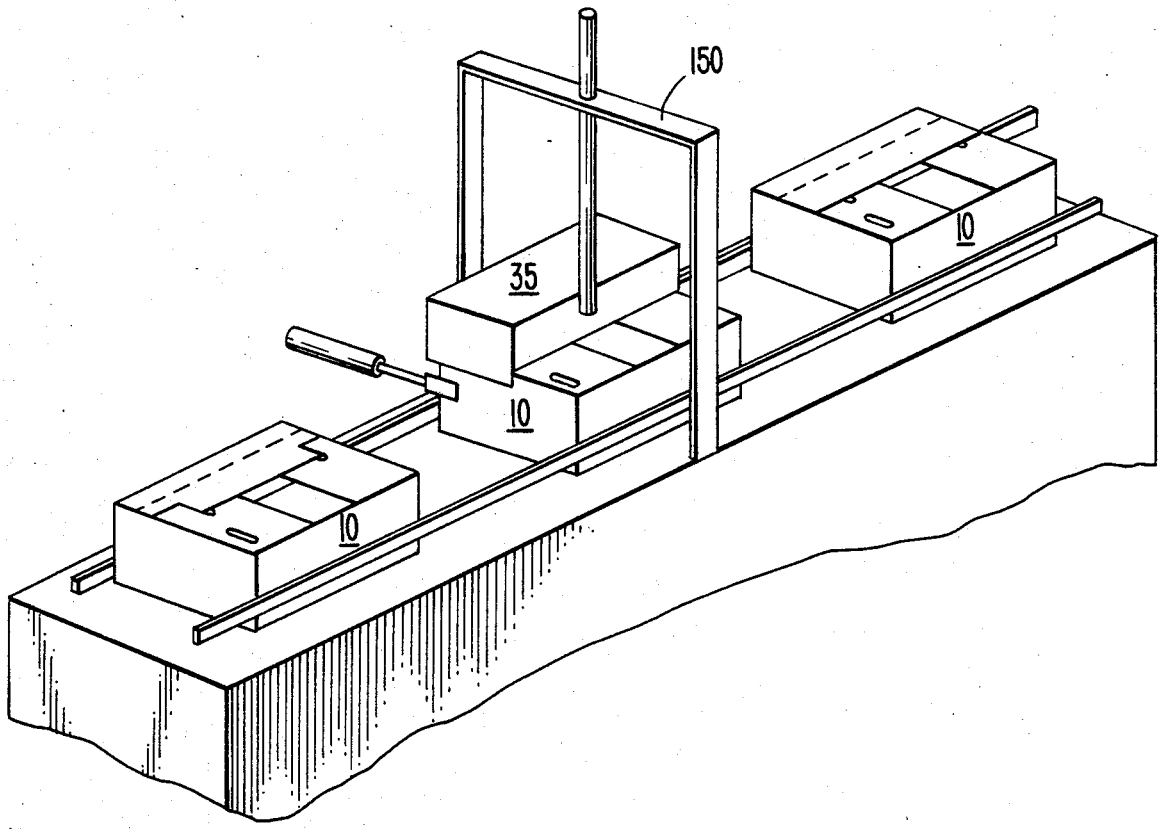
FIG. 7B is a perspective view, partly schematic, showing a case locking line for locking longitudinally oriented cases.

The invention further solves a previous problem in the art of automatic case packing by being rotationally adjustable to lock cases which are oriented longitudinally or laterally. See FIGS. 7A and 7B. Previously known box closing devices of various types are too cumbersome to be efficiently rotated, requiring that the boxes be rotated before entering the box closing station. Suitable means for rotating an apparatus according to this invention is shown in FIG. 6, with reference to FIGS. 7A and 7B. This means includes a threaded collar 178 rotatable on complementary threads 59 of main shaft 152. The device is rotated by loosening threaded collar 178 on threads 59. Cylinder support 43 then is raised and rotated, e.g., 90°, until the desired position is achieved with half-circle slots 180 seated on to pin 182, which is fixedly connected to shaft 152. The position of the apparatus then is locked by tightening collar 178 down on support 43.

While this invention has been shown and described in some detail, it will be understood that this description and the accompanying drawings are offered merely by way of example, and are not to be construed as limiting.

What is claimed is:

1. An apparatus for locking a top of a case having an unlocked closing flap and L-slide lock slots for receiving opposite free end corners of the closing flap, the apparatus comprising:

(a) a closing flap securing member for detachably securing an unlocked closing flap of a stationary case, the case having a top portion which top portion includes said closing flap, the closing flap being connected to a top end of a side of the case, the closing flap having a free longitudinal edge and opposite free end corners, the top portion further including L-slide lock slots for receiving respective free end corners of the closing flap; and (b) means for moving the unlocked closing flap with the closing flap securing member secured thereto, from a generally horizontal unlocked position flush with the top of the case, to form a longitudinal fold in the closing flap between said free longitudinal edge and the connection between the closing flap and the side top end, with the free longitudinal edge of the closing flap at about the level of the side top end, to thereby position the opposite free end corners of the closing flap adjacent respective L-slide lock slots; and for thereafter flattening the longitudinal fold and tucking the opposite free end corners of the closing flap into respective L-slide lock slots to thereby lock the case.

2. The apparatus of claim 1 wherein the closing flap moving and flattening means comprises means for moving the closing flap securing member between a generally horizontal position and a generally inclined position relative to the top portion of the stationary case while the securing member is secured to the closing flap and while the free longitudinal edge of the closing flap remains at about the level of the side top end, wherein movement of the securing member from said generally horizontal position to said generally inclined position first forms a longitudinal fold in the closing flap and positions the opposite free end corners of the closing flap adjacent respective L-slide lock slots, and wherein subsequent movement of the securing member from said generally inclined position to said generally horizontal position then flattens the longitudinal fold and tucks the opposite free end corners of the closing flap into the respective L-slide lock slots to thereby lock the case.

3. The apparatus of claim 2 further including means for holding the case at a predetermined stationary position relative to the apparatus during locking of the case.

4. The apparatus of claim 2 wherein the closing flap securing member detachably secures the top surface of the closing flap through suction applied to the top surface of the closing flap by the securing member.

5. The apparatus of claim 4 further including means connected to the securing member for placing the securing member in position for detachably securing said top surface.

6. The apparatus of claim 5 wherein the securing member is located above the case when the case is at said predetermined stationary position, and wherein the securing member placing means lowers and raises the securing member to respectively place said securing member into and out of said position for detachably securing said top surface.

7. The apparatus of claim 6 wherein the securing member placing means includes a cylinder rod reciprocating in a cylinder.

8. The apparatus of claim 7 wherein said cylinder rod reciprocates in a generally vertical direction.

9. The apparatus of claim 2 wherein the means for moving the securing member is connected to the securing member by a pivotable linkage.

10. The apparatus of claim 9 wherein the means for moving the securing member includes a cylinder rod reciprocating in a cylinder, the cylinder rod being connected to said pivotable linkage.

11. The apparatus of claim 8 wherein the means for moving the securing member includes a cylinder rod reciprocating in a cylinder in a generally horizontal direction, the cylinder rod being connected to said pivotable linkage.

12. The apparatus of claim 9 wherein the pivotable linkage includes a pair of linkage members which are fixedly connected to each other, the linkage members together being rotatable about an axis adjacent the connection between the closing flap and the side top end, one of the linkage members being pivotably connected to the securing member and the other of the linkage members being pivotably connected to the securing member moving means.

13. The apparatus of claim 10 wherein the pivotable linkage includes a pair of linkage members which are fixedly connected to each other, the linkage members together being rotatable about an axis adjacent said top end of the side of the case, one of the linkage members being pivotably connected to the securing member and the other of the linkage members being pivotably connected to the means for moving the securing member.

14. The apparatus of claim 11 wherein the pivotable linkage includes a pair of linkage members which are fixedly connected to each other, the linkage members together being rotatable about an axis adjacent said top end of the side of the case, one of the linkage members being pivotably connected to the securing member and the other of the linkage members being pivotably connected to the means for moving the securing member.

15. The apparatus of claim 3 further including means for conveying the case to said predetermined stationary position.

16. The apparatus of claim 3 further including means for rotating the closing flap securing member at said predetermined position to place the closing flap securing member in position to lock the case.

17. The apparatus of claim 3 further including means for conveying the case away from said predetermined position after the case is locked.

18. The apparatus of claim 2 further including means for adjusting the apparatus for locking cases of different heights.

* * * * *